US006789364B2

(12) United States Patent
Popovich et al.

(10) Patent No.: US 6,789,364 B2
(45) Date of Patent: Sep. 14, 2004

(54) CEILING CLIP AND METHOD OF ASSEMBLY

(75) Inventors: Michael S. Popovich, Bartlett, IL (US); John T. Neil, St. Charles, IL (US); Thomas J. Vik, St. Charles, IL (US); Anthony R. Caringella, Norridge, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/361,219

(22) Filed: Feb. 10, 2003

(65) Prior Publication Data

US 2004/0154251 A1 Aug. 12, 2004

(51) Int. Cl.[7] ..... E04B 2/00

(52) U.S. Cl. ..... 52/506.01; 52/506.05; 52/506.06; 52/741.1; 52/745.1; 248/317; 411/441

(58) Field of Search ..... 52/506.05, 506.06, 52/698, 39, 741.1, 712; 248/302, 327, 317; 24/103, 114.05; 411/441, 440

(56) References Cited

U.S. PATENT DOCUMENTS

| | | | | | |
|---|---|---|---|---|---|
| 2,601,186 | A | | 6/1952 | Vinson | |
| 3,859,770 | A | * | 1/1975 | Chambers et al. | 52/745.05 |
| 3,965,624 | A | * | 6/1976 | Madonna | 52/28 |
| 4,096,964 | A | * | 6/1978 | Glick | 220/3.4 |
| 4,467,514 | A | * | 8/1984 | Dahlke | 52/741.1 |
| 4,595,969 | A | * | 6/1986 | McNair | 362/217 |
| 4,667,913 | A | * | 5/1987 | Peelle et al. | 248/228.7 |
| 4,979,715 | A | * | 12/1990 | Rancourt | 248/317 |
| 5,020,296 | A | * | 6/1991 | Aoshika | 52/741.1 |
| 5,040,573 | A | | 8/1991 | Shepard | |
| 5,280,812 | A | | 1/1994 | Bigelow | |
| 5,364,053 | A | * | 11/1994 | Rodgers | 248/302 |
| 5,664,754 | A | | 9/1997 | Gaenslen | |
| 5,758,465 | A | * | 6/1998 | Logue | 52/506.06 |
| 5,772,169 | A | * | 6/1998 | Blockley | 248/333 |
| 6,029,418 | A | * | 2/2000 | Wright | 52/745.1 |
| 2003/0201373 | A1 | | 10/2003 | Masas | |

FOREIGN PATENT DOCUMENTS

| | | |
|---|---|---|
| GB | 1 482 891 A | 8/1977 |

* cited by examiner

*Primary Examiner*—Peter M. Cuomo
*Assistant Examiner*—Erika Garrett
(74) *Attorney, Agent, or Firm*—Lisa M. Soltis; Mark W. Croll; Donald J. Breh

(57) ABSTRACT

A method of securing a wire includes the steps of providing a member having a substrate side and a wire hole, feeding a wire into the wire hole of the member, heading the wire to form a wire head, positioning the wire head adjacent to the substrate side of the member, and fastening the member to a substrate.

13 Claims, 3 Drawing Sheets

CEILING CLIP AND METHOD OF ASSEMBLY

BACKGROUND OF THE INVENTION

1. Field of the Invention

The present invention relates to a method for securing a wire to a substrate, particularly for hanging various objects like tubes, cables, or suspended ceilings.

2. Description of Related Art

Several methods have been used, with varying degrees of success, for securing a wire to a substrate such as a ceiling.

Typical methods involve fastening a clip to a ceiling with a suitable fastener such as a pin. The clip usually has a hole or a hook for attaching the wire.

The wire may be attached either before or after the clip is fastened to the ceiling, for example, by forming a wire loop through the hole or the hook and wrapping the wire around itself several times. An example of looping and wrapping a wire is the Viper Overhead Fastening System commercialized by Ramset Powder Fastening Systems.

Looping and wrapping a wire is a cumbersome process. Wire wrapping machines are disclosed in U.S. Pat. No. 5,040,573 to Shepard and U.S. Pat. No. 5,280,812 to Bigelow, but the machines are expensive and time-consuming to use.

In the typical looping-and-wrapping operation, the part of the clip that includes the hole or the hook is bent away from the ceiling in order to provide clearance for the wire.

For example, the Viper Overhead Fastening System uses an angled clip having a hole through which the wire is inserted. Angled clips have disadvantages both in manufacturing, which requires a bending step, and in use, because the center-to-center distance between fastener and wire can be undesirably large, thereby placing stress on the clip, in addition to the disadvantages mentioned above relating to mounting of ceiling clips and use of looping-and-wrapping methods.

In U.S. Pat. No. 4,979,715 to Rancourt, wire is looped and secured to a screw, without using a clip as an intermediate, but cumbersome wrapping is required and may interfere with driving of the screw.

U.S. Pat. No. 5,364,053 to Rodgers discloses that wire may be attached by crimping or soldering, but these complicated, time-consuming methods are unlikely to provide uniform results.

In U.S. Pat. No. 5,664,754 to Gaenslen, a "wire-like support member" is threaded through a downwardly depending multiple-slotted part of a right-angled ceiling clip, raising questions about the manufacture, use and results of the system disclosed.

In U.S. Pat. No. 5,758,465 to Logue, a long threaded rod is attached to a threaded ceiling clip, and yet another member is attached to the bottom of the rod, creating a complicated, expensive and awkward assembly.

What is needed is an improved method for securing a wire to a substrate that overcomes the above shortcomings. The method should be relatively easy, rapid, inexpensive and secure. It should allow use of conventional wire while avoiding right-angled and other substantial-angled clips and minimizing center-to-center distances between wire and fastener.

BRIEF SUMMARY OF THE INVENTION

In accordance with the present invention, a fast and efficient method of securing a wire comprises the steps of providing a member having a substrate side and a wire hole, feeding a wire into the wire hole, heading the wire to form a wire head, positioning the wire head adjacent to the substrate side, and fastening the member to a substrate. The inventive use of a head to secure a wire to a member makes this method fast, precise, and efficient, and also surprisingly allows the member to be a generally flat clip whose advantages are discussed below. In one embodiment, the member is a generally flat clip, has a wire head recess in the substrate side surrounding the wire hole and the positioning step positions the wire head in the wire head recess.

In another aspect of the invention, a fast and efficient method of securing a wire having an end to a ceiling comprises in order the steps of providing a clip having a ceiling side, a fastener hole, a wire hole, and a wire head recess in the ceiling side surrounding the wire hole, feeding the end of the wire into the wire hole, substantially simultaneously cutting and heading the wire to form a wire head on the ceiling side of the clip, positioning the wire head in the wire head recess of the clip, and fastening the clip to the ceiling by driving a fastener through the fastener hole into the ceiling.

DETAILED DESCRIPTION OF THE INVENTION

Figure 7:
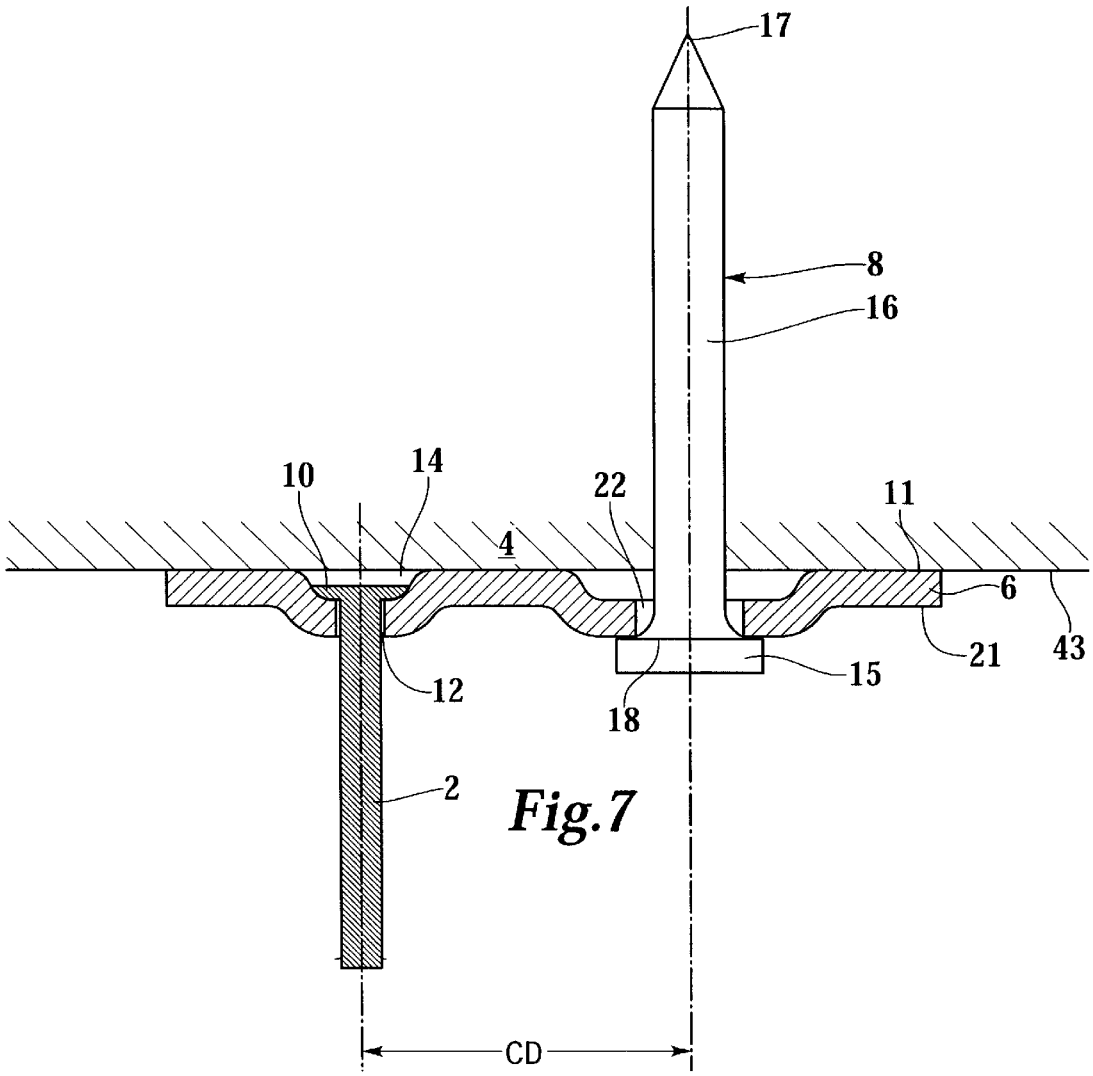
FIG. 7 shows the complete installation.

The drawings show the different steps of an innovative method for securing a wire 2 to a substrate or ceiling 4, with FIG. 7 showing the final installation where the securing is completed. Forming a head removes the need for wire looping and wrapping, which, as described above, is a cumbersome process. Securing wire 2 to member or clip 6 can be done in few simple and precise steps, allowing for quick securing of several wires with a precise control over the length of the wires. Furthermore, the inventive method is compatible with the use of a generally flat clip 6 as detailed below. Generally flat clip 6 allows a small center-to-center distance CD between wire 2 and pin 8, or any other fastener. A small center-to-center distance CD is desirable because it reduces the stress in clip 6. A generally flat clip 6 is also cheaper and easier to manufacture than an angled clip.

The method includes the steps of providing a clip 6 having a substrate or ceiling side 11 and a wire hole 12, feeding wire 2 into wire hole 12, forming a wire head 10 at a predetermined position on wire 2, positioning wire head 10 adjacent to substrate side 11, and fastening clip 6 to substrate or ceiling 4. In another embodiment, a wire head recess 14 is included in clip 6 surrounding wire hole 12 so that wire head 10 can be positioned in wire head recess 14.

In a preferred embodiment, the innovative method shown in FIGS. 2, 3, 6, and 7 includes the steps of providing a generally flat clip 6 having a wire hole 12 and a wire head recess or counter-bore 14 around wire hole 12, feeding a wire 2 into wire hole 12, heading wire 2 into wire head recess 14, substantially simultaneously cutting wire 2 to length, and fastening clip 6 to substrate 4. An interference-fit between wire head 10 and clip 6 keeps the two parts assembled.

Substrate 4 can be a ceiling or a wall. Wire 2 can be used to support various objects such as a cable, a tube or a suspended acoustical ceiling. In one embodiment, substrate 4 is a cement ceiling and wire 2 is an SAE 1010 steel wire having a diameter between about 0.05 inch and about 0.2 inch, preferably about 0.1 inch. A suspended acoustical ceiling or other object is secured to cement ceiling using a predetermined number of wires that can be as long as about eight feet. In a given installation, all wires should be substantially equal in length after wires are attached to ceiling.

Figure 6:
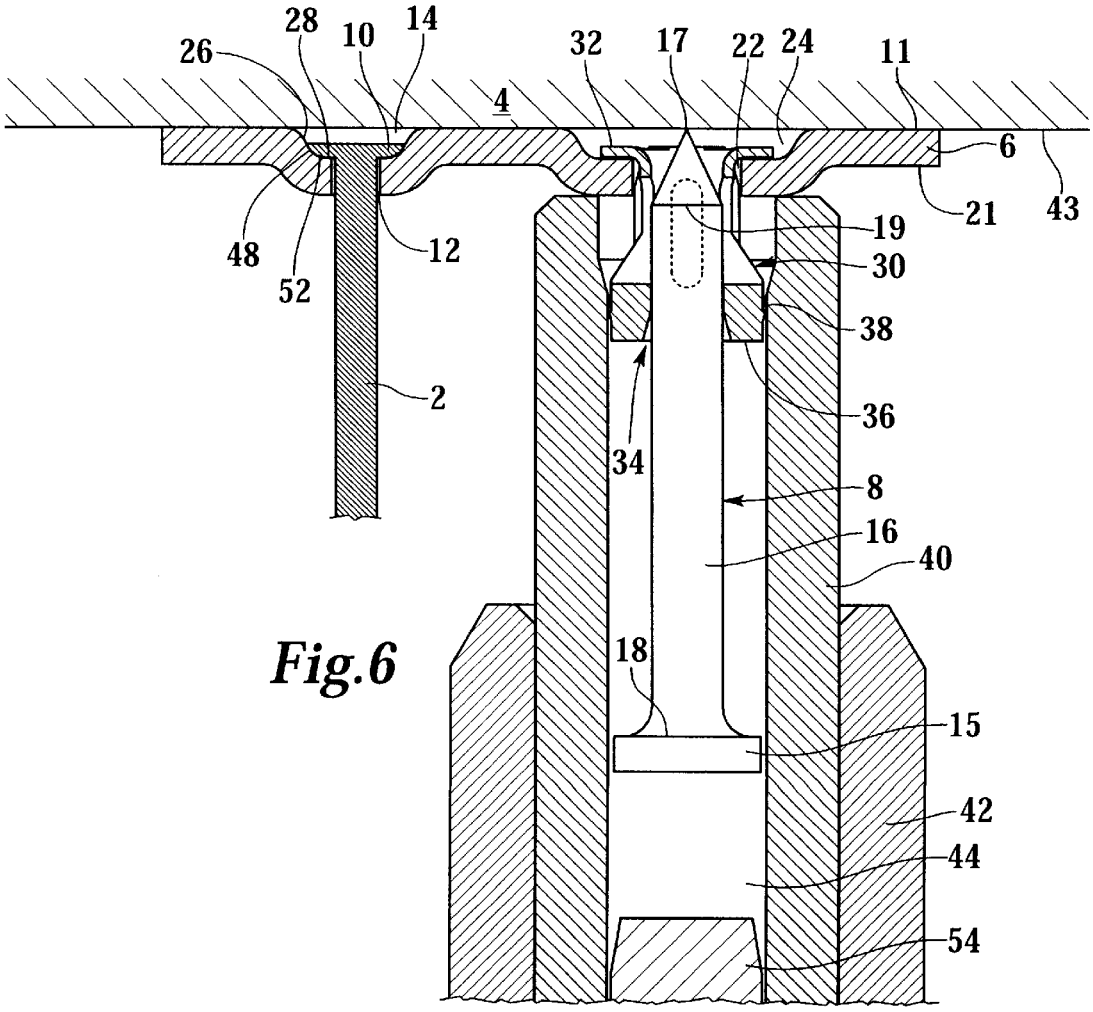
FIG. 6 shows the flute mounted in the muzzle of a power actuated tool.

In one embodiment, clip 6 is fastened to substrate 4 using a fastener or pin 8 wherein pin 8 is driven into substrate 4 using a power driven tool 42 shown in FIG. 6. The fastener is selected based on factors including the nature of the substrate and the intended load, it being necessary for the fastener to penetrate and remain in the substrate and to bear the intended load, thus, for example, a steel pin usually is appropriate for a cement ceiling.

Figure 2:
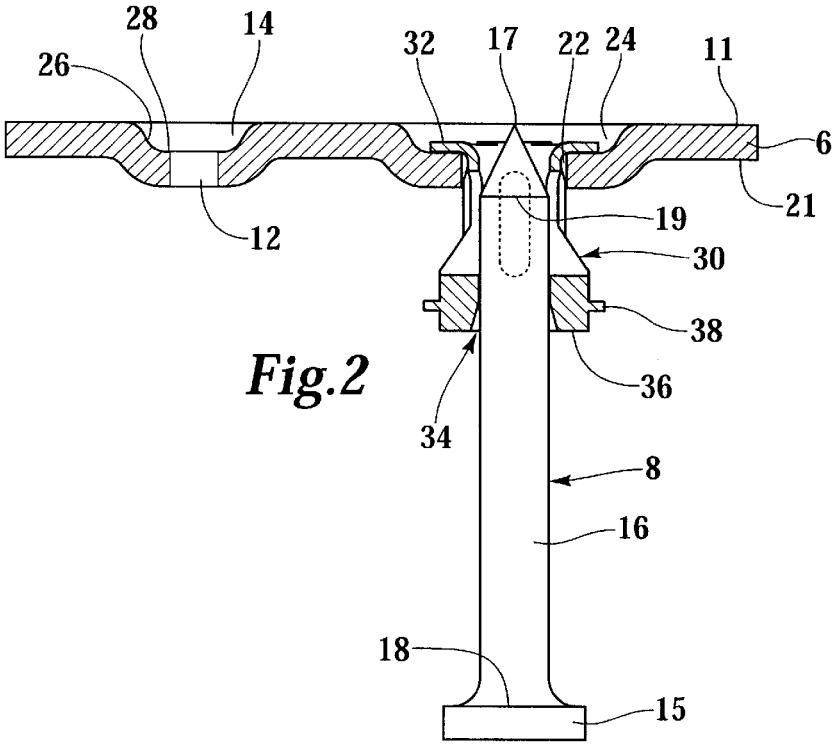
FIG. 2 shows a sectional view of the clip of FIG. 1 taken along lines 2—2 with a flute and a pin mounted in the clip.

Referring to FIG. 2, pin 8 has a pin head 15, a shank 16, and a tip 17. Preferably, shank 16 is generally cylindrical in shape and has a diameter that is significantly smaller than its length. Shank 16 has a trailing end 18 and a driving end 19. At trailing end 18, shank 16 is connected with pin head 15. Pin head 15 is also preferably generally cylindrical in shape but has a diameter that is significantly larger than its length and than the diameter of shank 16. Pin head 15 and shank 16 are connected together such that the two cylinders have same axis. At driving end 19 of shank 16 is tip 17. Tip 17 is generally conical in shape.

FIG. 2 shows a generally flat clip 6 to be used in the innovative method of the present invention. Clip 6 has a substrate side 11 that is placed adjacent to substrate 4 when clip 6 is fastened, as shown in FIG. 6, and an outer side 21 opposite substrate side 11. Clip 6 has two holes, a wire hole 12 and a fastener hole 22. Each hole extends through clip 6 from outer side 21 to substrate side 11. Fastener hole 22 has a diameter that is significantly smaller than the diameter of pin head 15, such that when pin 8 is driven through hole 22, pin 8 securely fastens clip 6 to substrate 4, as seen in FIG. 7.

Returning to FIG. 2, in a preferred embodiment, two recesses are formed in substrate side 11 of clip 6, a wire head recess 14 adjacent wire hole 12 and a flute recess 24 adjacent fastener hole 22. In one embodiment, wire head recess 14 is surrounding wire hole 12 and flute recess 24 is surrounding fastener hole 22. Preferably, clip 6 is metallic and each recess is formed by bending the metal of clip 6 around the corresponding hole to form a shallow indentation. Surrounding wire head recess 14 has a side surface 26 and a recess surface 28. Diameter of surrounding wire head recess 14 is preferably substantially larger than diameter of wire hole 12 and positioning step positions substantially all of wire head 10 in surrounding wire head recess 14. Still more preferably, diameter of wire head recess 14 is about twice the diameter of wire hole 12

In the embodiment shown in FIG. 2, a flute 30 is mounted in fastener hole 22. Flute 30 has wings 32 that help retain flute 30 in hole 22. Flute 30 is pushed through fastener hole 22 from outer side 21. Flexible wings 32 bend under the force applied as flute 30 is inserted in hole 22. Once on substrate side 11, wings 32 open up into flute recess 24 and flute 30 is mounted to clip 6. Flute 30 has a longitudinal hollow bore 34 in which pin 8 or other fastener is mounted. Flute 30 further comprises an annular portion 36 and centering elements 38 distributed around annular portion 36 such that flute 30 can be loaded and retained in muzzle 40 of a power actuated fastener driving tool 42, as seen in FIG. 6. Annular portion 36 and centering elements 38 cooperate with interior surface 44 of muzzle 40 to frictionally retain flute 30 and center it in muzzle 40. Flute 30 helps keep pin 8 substantially perpendicular to clip 6, and thus to substrate or ceiling surface 43 during driving. A preferred assembly of pin 8, flute 30, and clip 6 is described in the commonly assigned patent application entitled "Ceiling Clip" having Attorney Docket #13854, filed contemporaneously herewith, the disclosure of which is incorporated herein by reference.

One embodiment of the method of securing wire 2 to clip 6 includes the steps of feeding wire 2 into wire hole 12, heading wire 2, and cutting wire 2.

Figure 3:
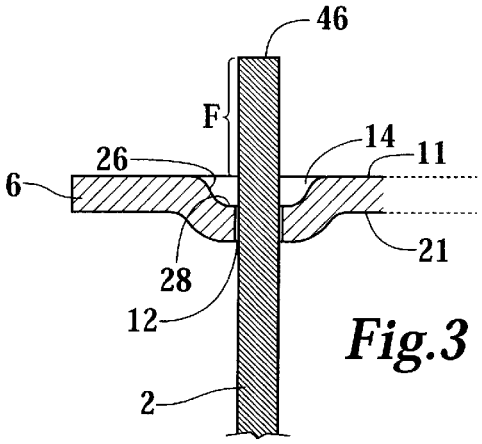
FIG. 3 shows a step of feeding of a wire.

In FIG. 3, wire 2 is fed into wire hole 12 of clip 6. An end 46 of wire 2 is fed through hole 12 from outer side 21 to substrate side 11, such that a fraction F of wire 2 is on substrate side 11.

Figure 4:
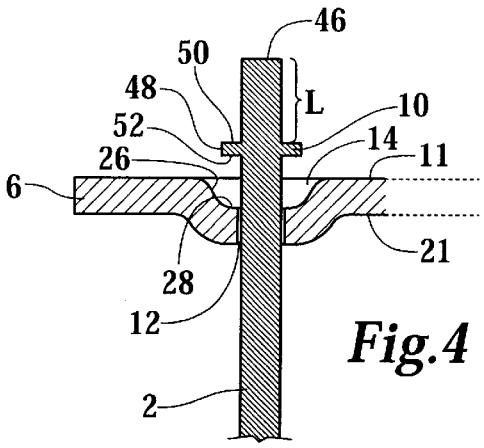
FIG. 4 shows the wire after a head is formed along the wire.

In FIG. 4, a wire head 10 is formed at a predetermined position along fraction F of wire 2 between end 46 of wire 2 and substrate side 11 of clip 6. Wire head 10 can be formed using a heading tool (not shown). An example of such a tool can grasp wire 2 at two proximate points, one on each side of predetermined position, and push the two points towards each other, compressing wire 2 and thus forming wire head 10. The tool can also cut wire 2 to length before heading or after heading, preferably substantially simultaneously with heading. The distance between predetermined position where wire head 10 is formed and substrate side 11 of clip 6 does not need to be very large, but should be large enough to allow the heading tool to form wire head 10. Wire head 10 preferably has a cylindrical shape with its diameter substantially larger than its height. Wire head 10 has a side surface 48, an upper surface 50 and a lower surface 52. For the securing of wire 2 to be strong, the shear area of wire head 10, i.e. the area of cylindrical side surface 48 of wire head 10, is at least substantially equal to, and preferably substantially larger than, the cross sectional area of wire 2, still more preferably about twice the cross sectional area of wire 2.

Figure 5:
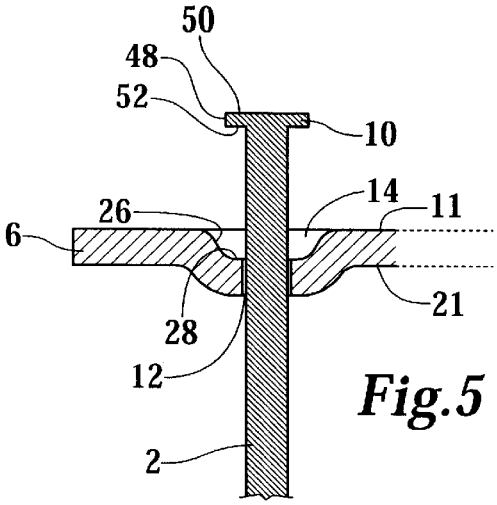
FIG. 5 shows the wire after being cut.

Heading step can leave a length L of wire 2 above wire head 10, followed by cutting length L of wire 2 above wire head 10. Wire 2 can be cut at a predetermined position further from wire head 10 with respect to clip 6, as shown in FIG. 5, i.e. between upper surface 50 of wire head 10 and end 46 of wire 2. Cutting is done as close as possible to upper surface 50 of wire head 10, preferably substantially flush to upper surface 50 of wire head 10 such that no substantial wire portion remains attached to wire head 10.

Heading step and cutting step can be performed substantially simultaneously by a heading tool designed to form wire head 10 and cut wire 2 in a single operation.

Alternatively, wire head 10 is formed at end 46 of wire 2, for example by hammering end 46 of wire 2. Wire 2 can be cut to a predetermined length before forming wire head 10.

In FIG. 6, wire head 10 is positioned in wire head recess 14. Preferably substantially all of wire head 10 is positioned in wire head recess 14. An interference-fit between lower surface 52 of wire head 10 and recess surface 28 around wire hole 12 keeps clip 6 and wire 2 assembled. The diameter of wire head 10 is larger than the diameter of wire hole 12 but smaller than or generally equal to the diameter of wire head recess 14 such that wire head 10 passes through wire head recess 14 but not through wire hole 12. Lower surface 52 of wire head 10, which is facing clip 6, is in contact with recess surface 28 around wire hole 12. Side surface 48 of wire head 10 faces side surface 26 of wire head recess 14. In one embodiment, the diameter of wire head 10 is generally equal to or slightly larger than the diameter of wire head recess 14, such that side surface 48 of wire head 10 is touching side surface 26 of wire head recess 14. Wire head 10 settles into wire head recess 14 due to gravity also, which helps keep wire head 10 and clip 6 assembled.

Alternatively, wire head 10 is formed directly in wire head recess 14 by heading wire 2 into recess 14 and substantially simultaneously cutting wire 2 to length. 100321 Continuing with FIG. 6, clip 6 is fastened to substrate 4 by driving pin 8 mounted in flute 30 through fastener hole 22 into substrate 4. Preferably, power actuated tool 42 is used to expedite the driving of pin 8, by firing it for example using gunpowder. Piston 54 of tool 42 engages pin head 15 and drives pin 8 into substrate 4. Flute 30 collapses under pin head 15, and may break away from pin 8 or seat beneath pin head 15 depending on the energy of tool 42. Pin 8 should be driven substantially perpendicular to substrate surface 43. If pin 8 is introduced at an angle, the contact between pin head 15 and the surface of outer side 21 of clip 6 around fastener hole 22 is not well distributed and clip 6 will not be properly fastened to substrate 4. Also, clip 6 can be damaged, and substrate 4 might fissure. Flute 30 keeps pin 8 substantially perpendicular to substrate surface 43 during firing to prevent the above mentioned problem. Flute 30 is also removable and replaceable so that if pin 8 is deformed, pin 8 and flute 30 can be replaced so that clip 6 is salvaged, reducing scrap created during the wire securing process.

The previously described steps can be performed in a different order. For example the clip can be fastened to the substrate before securing the wire to the clip, although in this case, the clip cannot be flat. The wire hole should not be adjacent to the substrate so that it is possible to feed the wire through the wire hole. For this reason, it is preferred that the wire be secured to the clip before fastening the clip to the substrate. Heading and cutting can be done substantially simultaneously or any of these two operations can precede the other, as described above. Heading and cutting also can be done substantially simultaneously using the same tool. Heading can be done before feeding the wire in the wire hole, but in this case an end of the wire opposite the head must be fed through the wire hole from the substrate side to the outer side.

In one embodiment, substrate 4 is a ceiling. Clip 6 is a ceiling clip. Fastening step fastens ceiling clip 6 to ceiling 4 by driving pin 8 through fastener hole 22 into ceiling 4. Ceiling clip 6 has a wire head recess 14 in substrate side 11. Positioning of wire head 10 is in wire head recess 14. Preferably, wire head recess 14 surrounds wire hole 12, and positioning of wire head 10 is in surrounding wire head recess 14. Also, preferably ceiling clip 6 is generally flat and fastening step fastens generally flat ceiling clip 6 substantially flush with ceiling 4.

Figure 1:
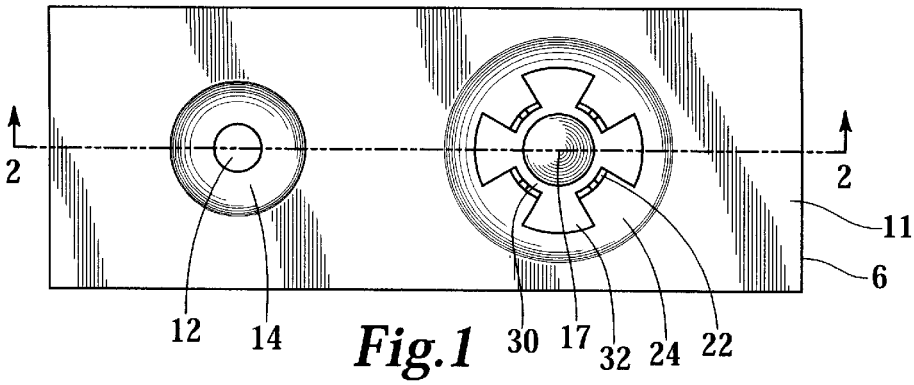
FIG. 1 shows a generally flat clip.
Figure 8:
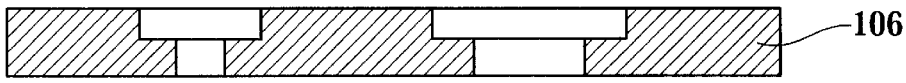
FIG. 8 shows another embodiment of the clip.

The fact that wire 2 is headed and fit in wire head recess 14 instead of being, for example, looped and wrapped, removes the need for a clearance for wire 2, thus allowing clip 6 to be generally flat as shown in FIG. 2. A generally flat clip 6 is easier to manufacture than an angled clip or a clip with a hook. The manufacturing process of a generally flat clip 6 includes drilling or punching two holes 12 and 22 in a flat plate and forming a recess around each of the holes. Each recess can be formed by bending the plate to form a shallow indentation as shown in FIGS. 1 and 2. In another embodiment, each recess can be machined in clip 106 around the corresponding hole as shown in FIG. 8.

Returning to FIGS. 6 and 7, the generally flat shape of clip 6 allows clip 6 to be small and center-to-center distance CD between pin 8 and wire 2 to be reduced, reducing the stress generated in clip 6. In fact, a clip fastened to a substrate 4 should have a generally flat portion that is substantially flush to substrate surface 43. If power actuated tool 42 is used for fastening, the generally flat portion should be substantially larger than muzzle 40 of power actuated tool 42 such that muzzle 40 can be fit on generally flat portion during driving. When using a generally flat clip, such as clip 6 shown in FIG. 6, the generally flat portion is the whole clip, and thus the clip can be small, allowing for a small center-to-center distance CD. In one embodiment, length of clip 6 is about one to about four times diameter of muzzle 40, preferably about 2.5 times diameter of muzzle 40. In the same embodiment, center-to-center distance CD is about half to about three times diameter of muzzle 40, preferably substantially equal to diameter of muzzle 40. Center-to-center distance CD is the distance between the axes of the two holes 12 and 22 and, thus, the distance between axes of two forces applied on clip 6; the force applied by wire 2 at wire hole 12 and the reaction applied by pin 8 at fastener hole 22. For the same magnitude of forces, the smaller the center-to-center distance CD, the smaller the stress in clip 6.

The innovative method also minimizes the assembly time by simplifying the procedure of securing wire 2 to substrate 4. There is no need to form a loop in wire 2 after introducing it in wire hole 12, then to twist wire 2 on itself, which is time consuming. Also, heading and cutting of wire 2 can be done substantially simultaneously in one simple step at a predetermined position on wire 2, which is more precise than looping wire 2, so that the length of wire 2 between clip 6 and the object that wire 2 is supporting can be controlled with a considerable precision. This is important for example if a multitude of wires are used to support a suspended ceiling; wires must have the same length to a considerable precision so that the suspended ceiling is substantially level.

While the invention has been described with respect to a preferred embodiment, it should be appreciated by those skilled in the art that variations and modifications may be made without departing from the spirit or scope of the invention. Therefore, the present invention should not be limited to the above described embodiment, but should be limited solely by the following claims.

The claimed invention is:

1. A method of securing wire to a substrate comprising the steps of:

providing a clip having a substrate side and a wire hole;

feeding a wire into said wire hole;

heading said wire to form a wire head that is larger than said wire hole;

positioning said wire head adjacent to said substrate side;

positioning said substrate side adjacent to said substrate; and fastening said clip to said substrate.

2. A method according to claim 1, wherein said heading step comprises leaving a length of wire above said wire head, said method further comprising cutting said length of wire.

3. A method according to claim 2, wherein said heading step and said cutting step are performed substantially simultaneously.

4. A method according to claim 1, wherein a side clip is a ceiling clip, said substrate is a ceiling, and said fastening step fastens said ceiling clip to said ceiling.

5. A method according to claim 4, wherein said ceiling clip has a wire head recess in said substrate side and said positioning of said wire head is in said wire head recess.

6. A method according to claim 5, wherein said wire head recess surrounds said wire hole and said positioning of said wire head is in said surrounding wire head recess.

7. A method according to claim 4, wherein said ceiling clip is generally flat and said fastening step fastens said generally flat ceiling clip substantially flush with said ceiling.

8. A method according to claim 5, wherein said wire hole has a first diameter, said wire head recess has a second diameter, said second diameter being substantially larger than said first diameter, and wherein said positioning step positions substantially all of said wire head in said wire head recess.

9. A method of securing a wire having an end to a ceiling comprising the following steps:

providing a generally flat clip having a ceiling side, a fastener hole, a wire hole, and a wire head recess in said ceiling side surrounding said wire hole;

feeding said end of said wire into said wire hole;

substantially simultaneously cutting and heading said wire to form a wire head on said ceiling side of said clip;

positioning said wire head in said wire head recess of said clip;

positioning said ceiling side of said clip adjacent to said ceiling; and fastening said clip to said ceiling by driving a fastener through said fastener hole into said ceiling.

10. A method according to claim 9, wherein said fastener is a pin, and said fastening step fastens said clip to said ceiling by driving said pin through said fastener hole into said ceiling.

11. A method according to claim 9, wherein said fastening step fastens said generally flat clip substantially flush with said ceiling.

12. A method according to claim 9, wherein said wire hole has a first diameter and said wire head recess has a second diameter, said second diameter being about twice said first diameter, and wherein said positioning step positions substantially all of said wire head in said wire head recess.

13. A method according to claim 1, wherein said fastening step includes driving a fastener through said clip into said substrate.

* * * * *